US006311841B1

(12) United States Patent
Hodges

(10) Patent No.: US 6,311,841 B1
(45) Date of Patent: Nov. 6, 2001

(54) LAP-TRAY AND PICNIC-SUPPLY CASE

(76) Inventor: Samuel E. Hodges, 2011 Hollywood Dr., Leesburg, FL (US) 34748

( * ) Notice: Subject to any disclaimer, the term of this patent is extended or adjusted under 35 U.S.C. 154(b) by 0 days.

(21) Appl. No.: 09/564,347

(22) Filed: May 4, 2000

(51) Int. Cl.[7] ..... A45C 11/20; B65D 1/36

(52) U.S. Cl. ..... 206/541; 206/564; 220/23.83

(58) Field of Search ..... 206/541, 542, 206/544, 545, 549, 564, 499; 220/23.83

(56) References Cited

U.S. PATENT DOCUMENTS

| | | | | |
|---|---|---|---|---|
| 848,889 | * | 4/1907 | Fitzgerald | 206/499 |
| 1,327,948 | | 1/1920 | Dennis . | |
| 1,458,679 | * | 6/1923 | Bishop | 206/541 |
| 1,885,483 | * | 11/1932 | Samuelson | 206/541 |
| 1,935,307 | * | 11/1933 | Ackerman | 206/541 |
| 2,061,965 | * | 11/1936 | Graeser | 206/541 |
| 2,397,225 | | 3/1946 | Walters . | |
| 3,799,386 | * | 3/1974 | Madalin et al. | 206/564 |
| 3,811,559 | * | 5/1974 | Carter | 206/545 |
| 3,938,688 | | 2/1976 | Ryan . | |
| 4,648,512 | | 3/1987 | Tarozzi et al. . | |
| 5,505,307 | * | 4/1996 | Shink | 206/541 |
| 5,704,485 | | 1/1998 | Cautereels et al. . | |
| 5,915,561 | | 6/1999 | Lorenzana et al. . | |
| 6,112,899 | * | 9/2000 | Zeringue | 206/541 |

FOREIGN PATENT DOCUMENTS

| | | | | |
|---|---|---|---|---|
| 2549354 | * | 1/1985 | (FR) | 206/541 |
| 16901 | | of 1894 | (GB) . | |

* cited by examiner

*Primary Examiner*—Bryon P. Gehman
(74) *Attorney, Agent, or Firm*—Edward M. Livingston, Esq.

(57) ABSTRACT

A lap-tray and picnic-supply case made of light material has a case receptacle (1) with a lap-tray lid (2) attached removably. The lap-tray lid has a lid-plate cradle (3) intermediate a bowl end with a lid-bowl cradle (4) and a cup end with a lid-cup cradle (5). Between the lid-bowl cradle and the lid-plate cradle is a first lid-utensil cradle (6) and between the lid-cup cradle and the lid-plate cradle is a second lid-utensil cradle (7). The lid-bowl cradle and the lid-cup cradle protrude downwardly to provide lap-side buttresses on outsides of legs (8) of a user. The first lid-utensil cradle and the second lid-utensil cradle have flat bottom surfaces for resting on the user's lap between opposite sides of an attachment rim (11) for fitting down over a top of a receptacle wall (10). The case receptacle has a plate compartment (12) below the lid-plate cradle, a bowl compartment (13) below the lid-bowl cradle, a napkin compartment (14) below the lid-cup cradle and a utensil compartment (15) below the first lid-utensil cradle for vertical stacking below the lap-lid tray. Cups (22) are stacked horizontally in a straight-walled bottom section having a case rest (17) on which the case rests in an upright carrying orientation. One or more inside trays (28) fit under the lap-tray lid and over compartment walls (37).

24 Claims, 5 Drawing Sheets

LAP-TRAY AND PICNIC-SUPPLY CASE

BACKGROUND OF THE INVENTION

This invention relates to lap trays combined with picnic-supply containers.

Carrying picnic supplies to a beach, a park or other remote place and having a picnic or party there can be a bit troublesome. Consequently, various known food containers and picnic-supply containers have been devised to ease related problems.

None are known, however, to provide a clean and convenient carrying case that also has lap-tray advantages in a manner taught by this invention.

Examples of a known related but different cases are described in the following patent documents. U.S. Pat. No. 5,915,561, issued to Lorenzana, et al. on Jun. 29, 1999 described a lap tray that was not an enclosure. U.S. Pat. No. 5,704,485, issued to Cautereels, et al. on Jan. 6, 1998, described a food container with an internal cooler, not a supply container or lap tray. U.S. Pat. No. 4,648,512, issued to Tarozzi, et al. on Mar. 10, 1987, described a portable cooler that was a tray, not a picnic-ware container. U.S. Pat. No. 3,938,688, issued to Ryan on Feb. 17, 1976, described a covered serving tray for hospitals and other institutions. U.S. Pat. No. 2,397,225, issued to Walters on Mar. 26, 1946, described a camping kit without tray features. U.S. Pat. No. 1,885,483, issued to Samuelson on Nov. 1, 1932, described a several-ply lap tray. U.S. Pat. No. 1,327,948, issued to Dennis on Jan. 13, 1920, described a food container structured also to be a stove and cooking utensil. British Patent No. 16,901, issued to Harverson on Sep. 5, 1894, described a rectangular food container having a top that could be used as a plate.

SUMMARY OF THE INVENTION

Objects of patentable novelty and utility taught by this invention are to provide a lap-tray and picnic-supply case which:

- is lightweight;
- is safely and easily closable and openable;
- has dividers for arrangement of picnic supplies such as disposable plates, cups, eating utensils and napkins;
- has a top with lap-tray structure for cradling most-used plates, bowls, cups and utensils in addition to having a conveniently sized and positioned flat table top;
- has a case-carrying handle; and
- has optional additional trays inside.

This invention accomplishes these and other objectives with a lap-tray and picnic-supply case having a tray-shaped lid with a matching case receptacle having supply compartments that correspond to the tray-shaped lid. One or more optional and separate inside lap trays may also be provided for additional persons to use.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
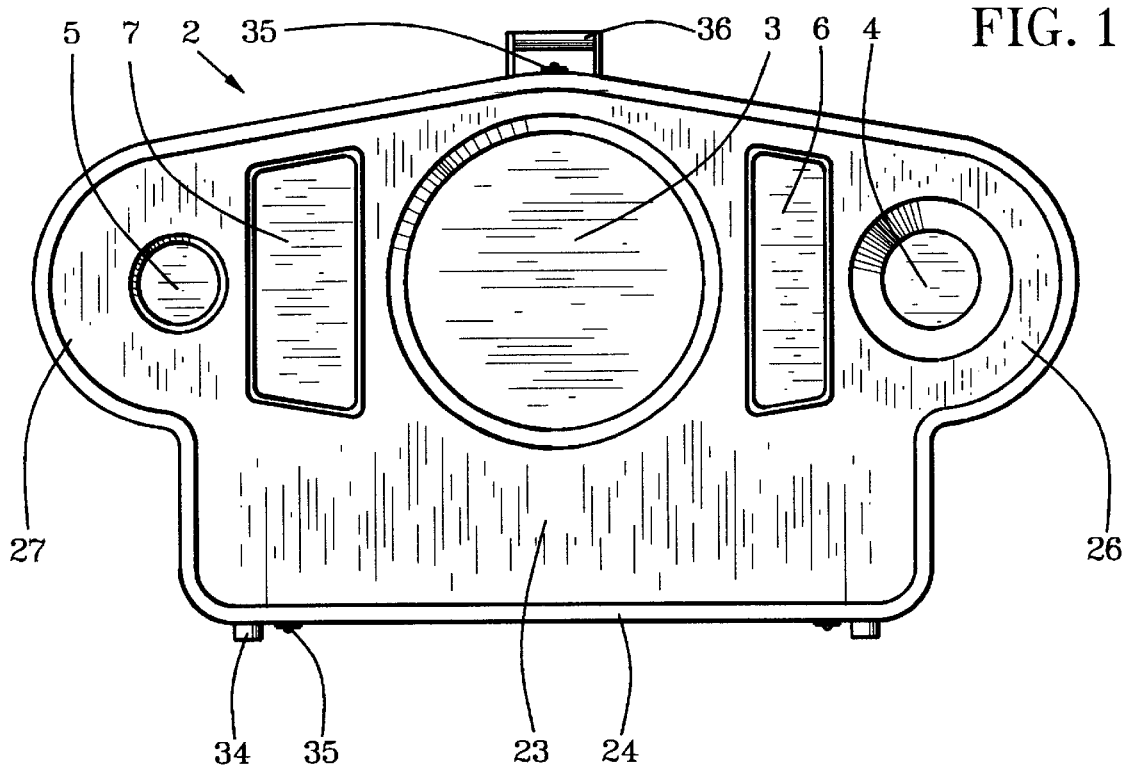
FIG. 1 is a front elevation view of an assembled shoulder embodiment in a vertical orientation for being carried.

Listed numerically below with reference to the drawings are terms used to describe features of this invention. These terms and numbers assigned to them designate the same features throughout this description.

| | |
|---|---|
| 1. | Case receptacle |
| 2. | Lap-tray lid |
| 3. | Lid-plate cradle |
| 4. | Lid-bowl cradle |
| 5. | Lid-cup cradle |
| 6. | First lid-utensil cradle |
| 7. | Second lid-utensil cradle |
| 8. | Legs of user |
| 9. | Receptacle floor |
| 10. | Receptacle wall |
| 11. | Attachment rim |
| 12. | Plate compartment |
| 13. | Bowl compartment |
| 14. | Napkin compartment |
| 15. | Utensil compartment |
| 16. | Cup compartment |
| 17. | Case rest |
| 18. | Plates |
| 19. | Bowls |
| 20. | Utensils |

-continued

| | |
|---|---|
| 21. | Napkins |
| 22. | Cups |
| 23. | Tray flat |
| 24. | Retainer wall |
| 25. | Lid-tray surface |
| 26. | First-shoulder portion |
| 27. | Second-shoulder portion |
| 28. | Inside tray |
| 29. | Tray-plate cradle |
| 30. | Tray-bowl cradle |
| 31. | Tray-cup cradle |
| 32. | First tray-utensil cradle |
| 33. | Second tray-utensil cradle |
| 34. | Buffer feet |
| 35. | Fasteners |
| 36. | Case handle |
| 37. | Compartment walls |

Referring to FIGS. 1–4, a case receptacle 1 has a lap-tray lid 2 having a lid-plate cradle 3 intermediate a lid-bowl end with a lid-bowl cradle 4 and a lid-cup end with a lid-cup cradle 5. A first lid-utensil cradle 6 is positioned intermediate the lid-plate cradle 3 and the lid-bowl cradle 4. A second lid-utensil cradle 7 is positioned intermediate the lid-plate cradle 3 and the lid-cup cradle 5.

Figure 7:
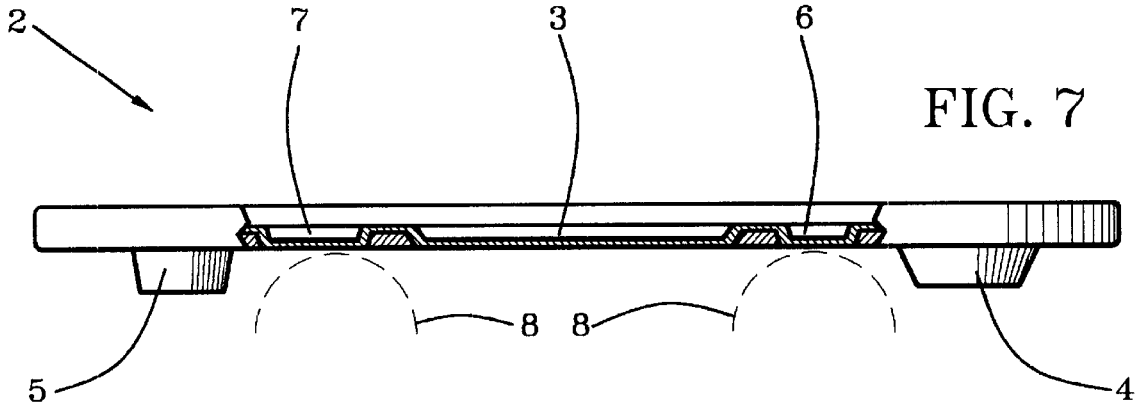
FIG. 7 is a partially cutaway front view of a case lid for use as a tray with cup and bowl cradles on opposite sides of legs of a user on whose lap the case lid is positioned.

For lap-position buttressing, the lid-bowl cradle 4 and the lid-cup cradle 5 are extended downwardly outside of legs 8 of a user on whose lap the lap-tray lid 2 is positioned as depicted in FIG. 7.

The case receptacle 1 has a receptacle floor 9 with an outside periphery from which a receptacle wall 10 is extended upward vertically from a horizontal access orientation of the receptacle floor 9.

An attachment rim 11 is extended downwardly from an outside edge of the lap-tray lid 2 to surround a top portion of the receptacle wall 10 with the case receptacle 1 and the lap-tray lid 2 having shape-matching structure.

The first lid-utensil cradle 6 and the second lid-utensil cradle 7 have flat bottom surfaces to rest on the legs 8 of the user proximate leg-rest positions internally from the attachment rim 11 as depicted in FIG. 7.

Corresponding to the lap-tray lid 2 in a position on the case receptacle 1, the case receptacle 1 has a plate compartment 12 vertically below the lid-plate cradle 3, a bowl compartment 13 vertically below the lid-bowl cradle 4, a napkin compartment 14 vertically below the lid-cup cradle 5, and a utensil compartment 15 vertically below the first lid-utensil cradle 6 for vertical stacking in the receptacle case 1. A cup compartment 16 has a case rest 17 on a bottom portion.

Plates 18, bowls 19, utensils 20 and napkins 21 are stacked vertically with the case receptacle 1 and receptacle floor 9 oriented horizontally for access. Cups 22 are stacked horizontally.

A tray flat 23 is provided on the lap-tray lid 2 intermediate the lid-plate cradle 3 and the case-rest 17 portion of the lap-tray lid 2.

Figure 2:
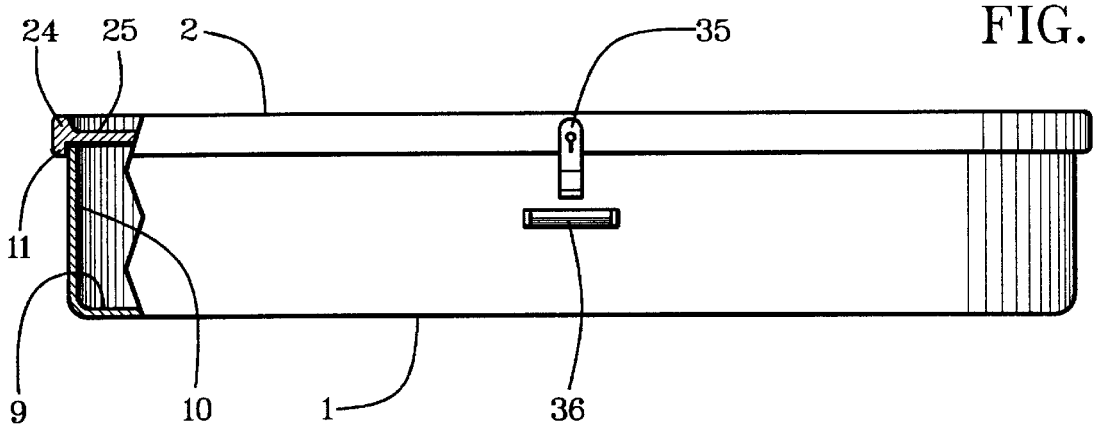
FIG. 2 is a partially cutaway top view of either a shoulder embodiment or a rectangular embodiment.
Figure 3:
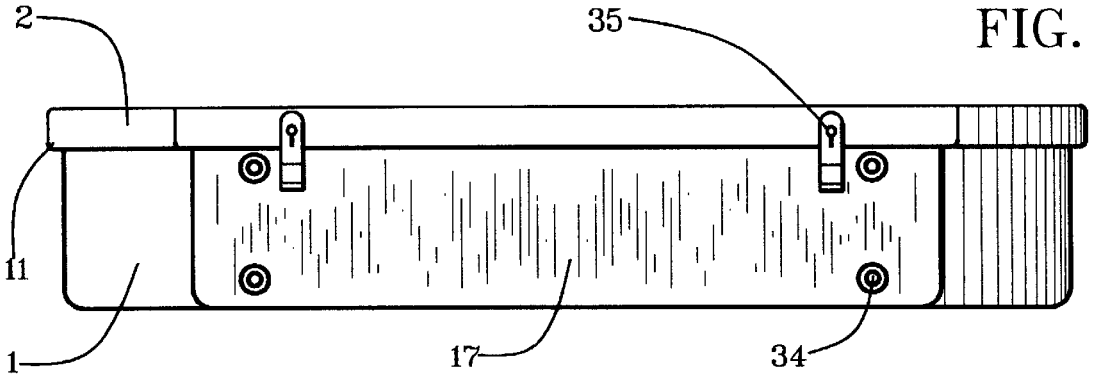
FIG. 3 is a bottom view of the assembled shoulder embodiment.
Figure 4:
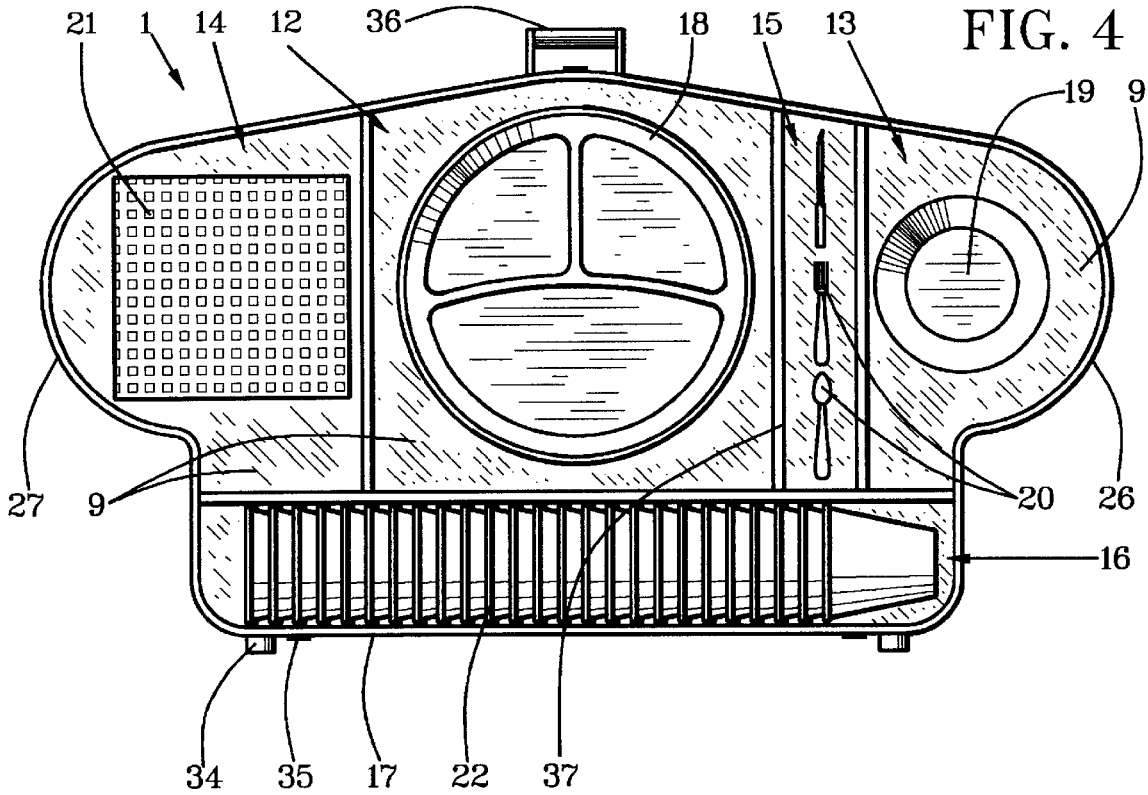
FIG. 4 is an open front view of a case receptacle for the shoulder embodiment in a horizontal orientation for being accessed to be loaded and unloaded and showing tops of stacked picnic items.

As depicted in FIG. 2, a retainer wall 24 is extended upwardly from the attachment rim 11 to a predetermined height vertically above a lid-tray surface 25 to deter falling of food items and food-container items off of the lap-tray lid 2 when positioned for use on the user's lap or on other unstable, slanting or movable support bases. The retainer wall 24 preferably has arcuate contact with the lid-tray surface 25 and has an arcuate top edge.

Preferably, the case receptacle 1 and the lap-tray lid 2 are made of predeterminedly light, thin and rigid material.

A predetermined first-shoulder portion 26 of the lid-bowl end and a predetermined second-shoulder portion 27 of the lid-cup end of the lap-tray lid 2 and correspondingly shape-matching structure of the receptacle wall 10 are extended outwardly beyond ends of the case rest 17 proximate the cup compartment 16 of a shoulder embodiment.

Referring to FIGS. 10–14, the case rest 17 proximate the cup compartment 16 has a length that is proximate a length of the lap-tray lid 2 intermediate an outside edge of the lid-bowl 4 end and an outside edge of the lid-cup 5 end of the lap-tray lid 2 of a rectangular embodiment.

Figure 5:
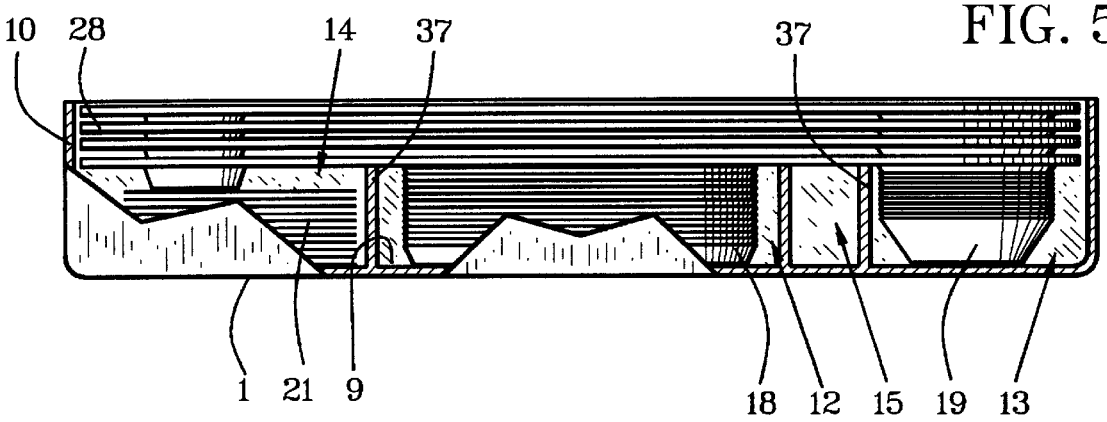
FIG. 5 is a partially cutaway top view of the case receptacle of either the shoulder embodiment or the rectangular embodiment showing sides of stacked arrangements of picnic items.
Figure 6:
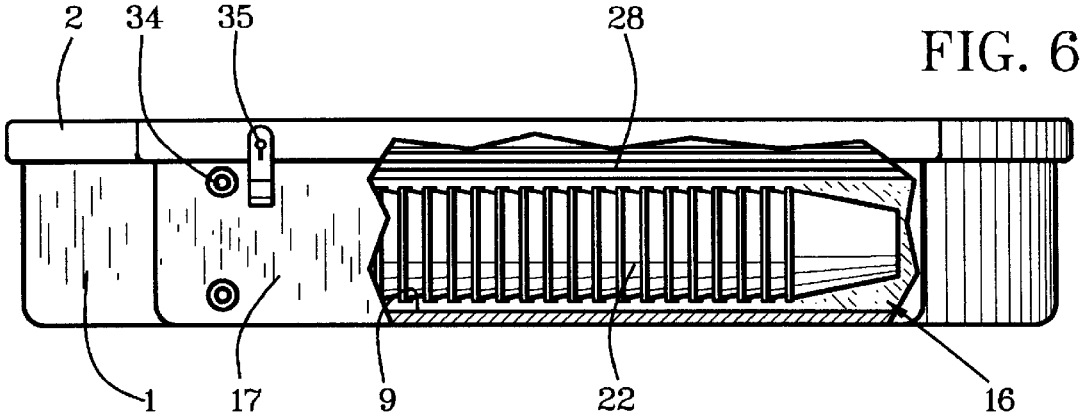
FIG. 6 is a partially cutaway bottom view of the shoulder embodiment assembled.
Figure 8:
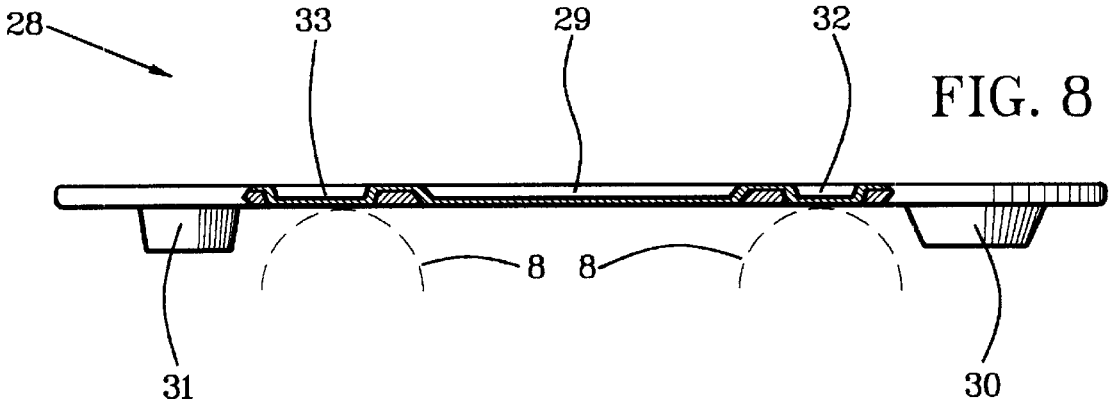
FIG. 8 is a partially cutaway front view of an inside tray with cup and bowl cradles on opposite sides of the legs of the user.
Figure 9:
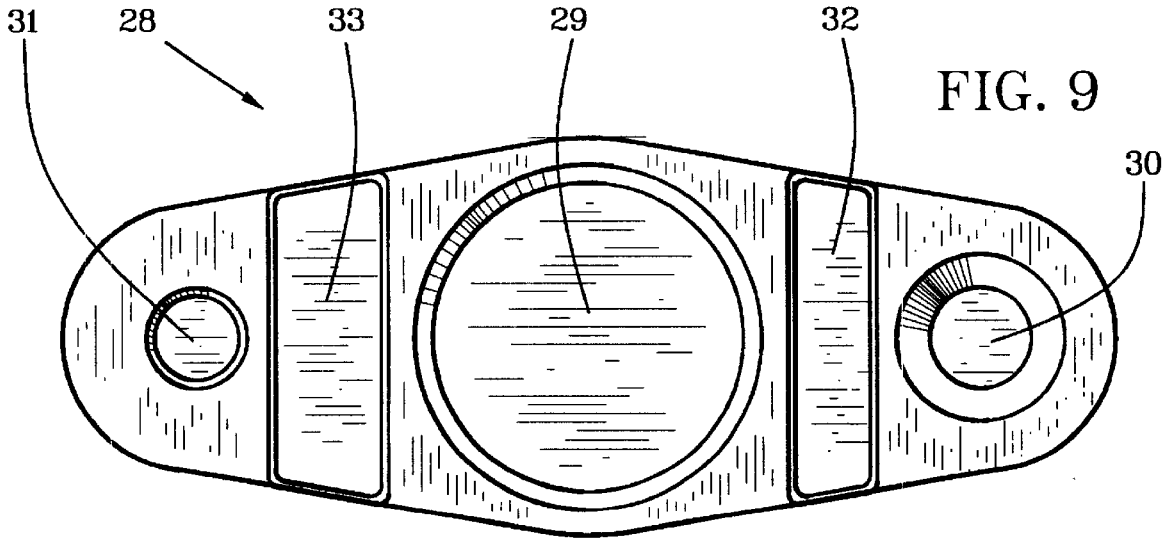
FIG. 9 is a top view of the inside tray.
Figure 10:
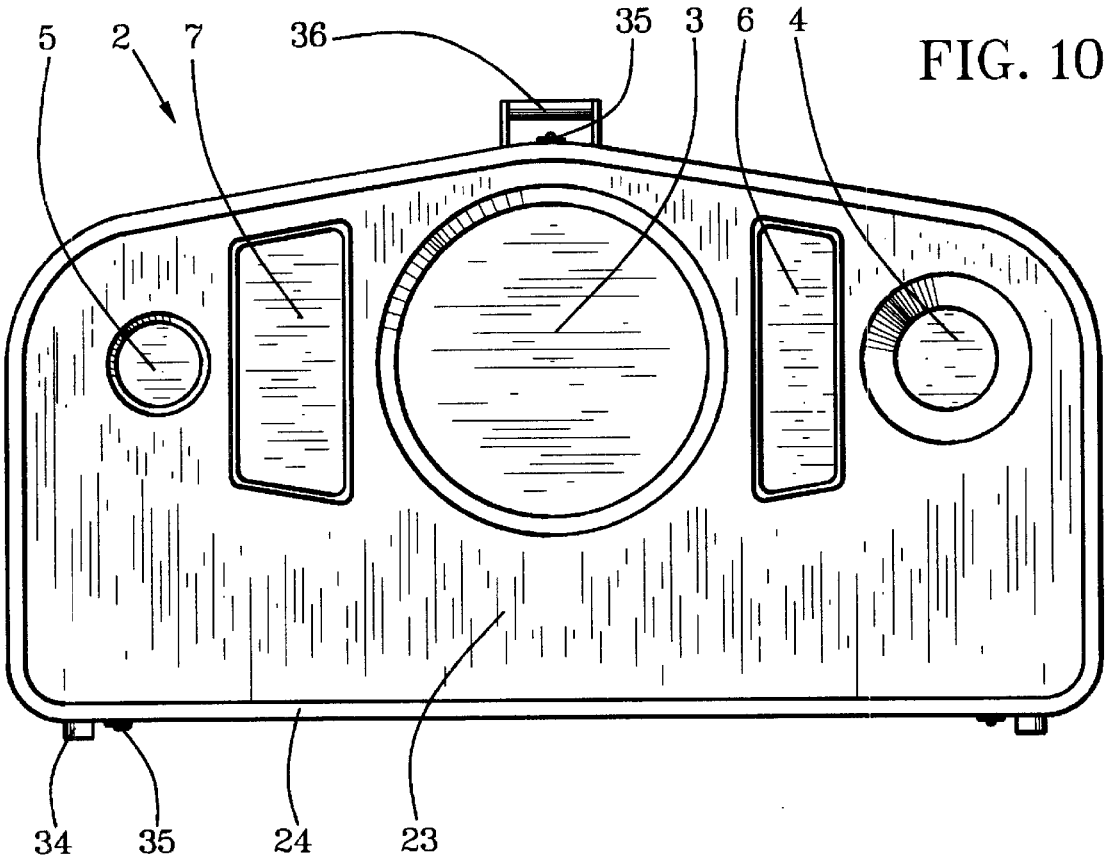
FIG. 10 is a front elevation view of the assembled rectangular embodiment in a vertical orientation for being carried.
Figure 11:
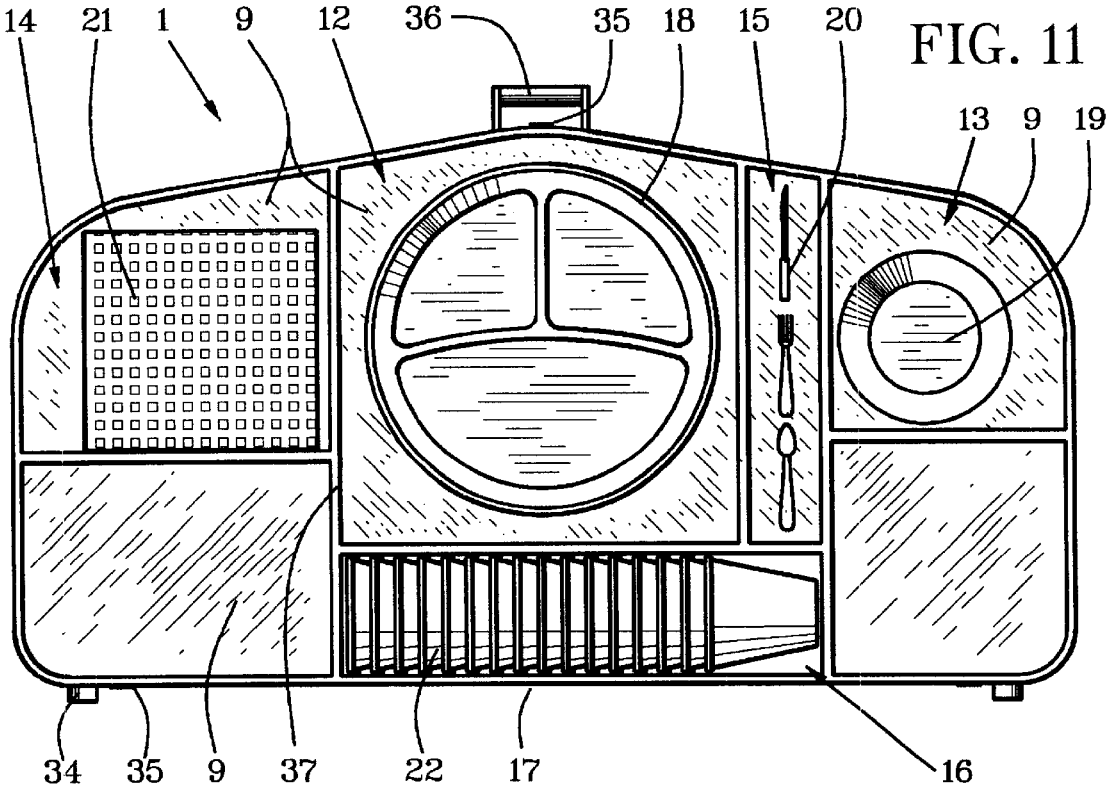
FIG. 11 is an open front view of the case receptacle for the rectangular embodiment in a horizontal orientation for being accessed to be loaded and unloaded and showing tops of stacked picnic items.
Figure 12:
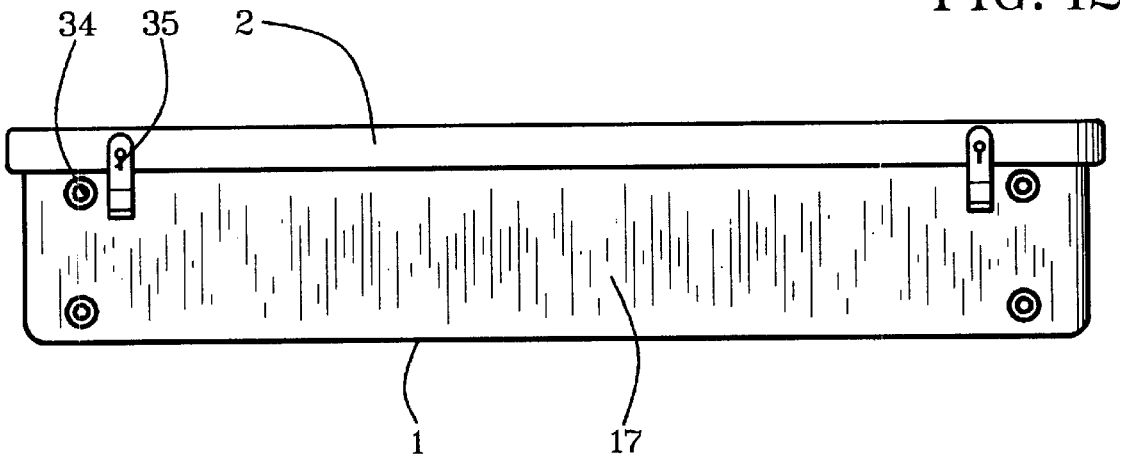
FIG. 12 is a bottom view of the assembled rectangular embodiment.
Figure 13:
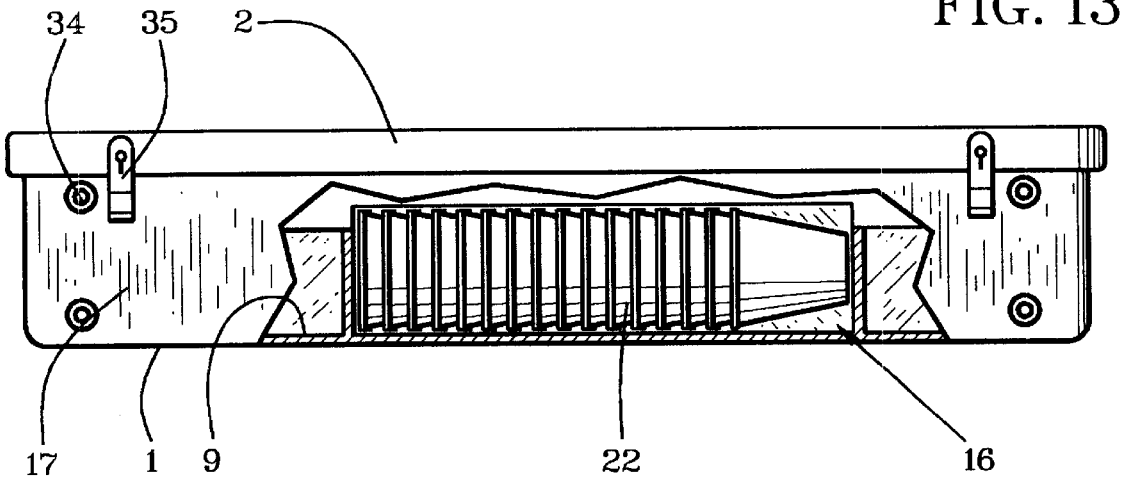
FIG. 13 is a partially cutaway bottom view of the rectangular embodiment assembled showing bottom items and compartments.
Figure 14:
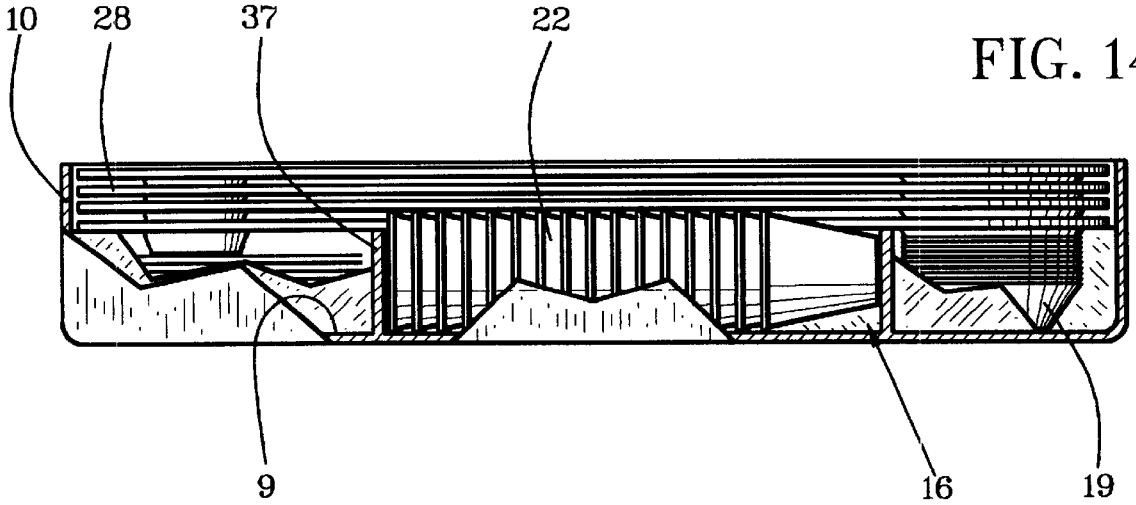
FIG. 14 is a partially cutaway bottom view of the rectangular embodiment assembled showing top and bottom items and compartments.

As shown separately in FIGS. 8–9 and as shown plurally stacked in FIGS. 5–6 and 14, one or more optional inside trays 28 have a tray-plate cradle 29 intermediate a tray-bowl end with a tray-bowl cradle 30 and a cup end with a tray-cup cradle 31. The tray-plate cradle 29 is axially concentric with the lid-plate cradle 3 shown in FIGS. 1, 7 and 10. The tray-bowl cradle 30 is axially concentric with the lid-bowl cradle 4 shown in FIGS. 1, 7 and 10. The tray-cup cradle 31 is axially concentric with the lid-cup cradle 5 shown in FIGS. 1, 7 and 10. The inside tray 28 has inside tray ends sized and shaped to fit within ends of an inside periphery of the case receptacle 1.

A first tray-utensil cradle 32 and a second tray-utensil cradle 33 on the inside tray 28 and on duplicates thereof are extended downwardly predetermined distances to rest on the legs 8 of the user intermediate the tray-bowl cradles 30 and the tray-cup cradles 31 which are extended downwardly predetermined distances for buttress positioning of the inside tray 28.

A plurality of buffer feet 34 on a case-rest 17 side of the receptacle wall 10 position the attachment rim 11 and the retainer wall 24 vertically above a surface on which the case rest 17 is positioned in upright carrying orientation of the case receptacle 1 and the lap-tray lid 2 when fastened together.

Various fastening means, such as a snap seal similar to that on a TUPPERWARE® container or one or more lid fasteners 35, may be used to fasten the lap-tray lid 2 to the case receptacle 1 for carrying mode.

Preferably, a case handle 36 is positioned on a top central portion of the case receptacle.

Referring to FIGS. 4, 5, 11 and 14, the plate compartment 12, the bowl compartment 13 and the napkin compartment 14 can have compartment walls 37 to accommodate one or a predetermined plurality of inside trays 28 stacked successively intermediate a bottom of the lap-tray lid 2 and top edges of the compartment walls 37.

Preferably, the tray-plate cradle 29 has an inside periphery that is truncate conical; the lid-plate cradle 3 has an outside periphery that is truncate conical; the outside periphery of the lid-plate cradle 3 is sized and shaped to fit predeterminedly in the inside periphery of the tray-plate cradle 29; the tray-bowl cradle 30 has an inside periphery that is truncate conical; the lid-bowl cradle 4 has an outside periphery that is truncate conical; the outside periphery of the lid-bowl cradle 4 is sized and shaped to fit predeterminedly in the inside periphery of the tray-bowl cradle 30; the tray-cup cradle 31 has an inside periphery that is truncate conical; the lid-cup cradle 5 has an outside periphery that is truncate conical; and the outside periphery of the lid-cup cradle 5 is sized and shaped to fit in the inside periphery of the tray cup cradle 31.

A new and useful lap-tray and picnic-supply case having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A lap-tray and picnic-supply case comprising:

a case receptacle with a lap-tray lid attached removably;

the lap-tray lid having a lid-plate cradle intermediate a lid-bowl end with a lid-bowl cradle and a lid-cup end with a lid-cup cradle;

a first lid-utensil cradle intermediate the lid-plate cradle and the lid-bowl cradle;

a second lid-utensil cradle intermediate the lid-plate cradle and the lid-cup cradle;

the lid-bowl cradle and the lid-cup cradle being extended downwardly outside of legs of a user on whose lap the lap-tray lid is positioned;

the case receptacle having a receptacle floor with an outside periphery from which a receptacle wall is extended upwardly from a horizontal access orientation of the receptacle floor;

an attachment rim extended downwardly from an outside edge of the lap-tray lid to surround a top portion of the receptacle wall with the case receptacle and the lap-tray lid having shape-matching structure;

the first lid-utensil cradle having a flat bottom surface and the second lid-utensil cradle having a flat bottom surface to rest on the legs of the user proximate leg-rest positions internally from the attachment rim;

the case receptacle having a plate compartment vertically below the lid-plate cradle with the lap-tray lid positioned on the case receptacle, a bowl compartment vertically below the lid-bowl cradle with the lap-tray lid positioned on the case receptacle, a napkin compartment vertically below the lid-cup cradle with the lap-tray lid positioned on the case receptacle, and a utensil compartment vertically below the first lid-utensil cradle with the lap-tray lid positioned on the case receptacle for vertical stacking in the case receptacle; and the case receptacle having a cup compartment proximate a case-bottom portion with a horizontal wall for a case rest with the lap-tray and picnic-supply case in an upright position for being carried.

2. The lap-tray and picnic-supply case of claim 1 and further comprising:

a tray flat on the lap-tray lid intermediate the lid-plate cradle and a case-rest portion of the lap-tray lid.

3. The lap-tray and picnic-supply case of claim 1 and further comprising:

a retainer wall extended upwardly from the attachment rim to a predetermined height vertically above a lid-tray surface to deter falling of food items and food-container items off of the lap-tray lid when positioned for use on the user's lap or on other unstable, slanting or movable support bases.

4. The lap-tray and picnic-supply case of claim 3 wherein:

the retainer wall has arcuate contact with the lid-tray surface and has an arcuate top edge.

5. The lap-tray and picnic-supply case of claim 1 wherein:

the case receptacle and the lap-tray lid are made of a predeterminedly light, thin and rigid material.

6. The lap-tray and picnic-supply case of claim 1 wherein:

a predetermined first-shoulder portion of the lid-bowl end and a predetermined second-shoulder portion of the lid-cup end of the lap-tray lid and correspondingly shape-matching structure of the case receptacle are extended outwardly beyond ends of the case rest proximate the cup compartment of a shoulder embodiment.

7. The lap-tray and picnic-supply case of claim 1 wherein:

the case rest proximate the cup compartment has a length that is proximate a length of the lap-tray lid intermediate an outside edge of the lid-bowl end and an outside edge of the lid-cup end of the lap-tray lid of a rectangular embodiment.

8. The lap-tray and picnic-supply case of claim 1 wherein:

the lid-plate cradle, the lid-bowl cradle and the lid-cup cradle have inside peripheries that are truncate conical to receive predetermined ranges of sizes of plates, bowls and cups having external structures that are truncate conical.

9. The lap-tray and picnic-supply case of claim 1 and further comprising:

at least one inside tray having a tray-plate cradle intermediate a tray-bowl end with a tray-bowl cradle and a tray-cup end with a tray-cup cradle;

the tray-plate cradle being axially concentric with the lid-plate cradle;

the tray-bowl cradle being axially concentric with the lid-bowl cradle;

the tray-cup cradle being axially concentric with the lid-cup cradle; and the inside tray having inside-tray ends sized and shaped to fit within ends of an inside periphery of the case receptacle.

10. The lap-tray and picnic-supply case of claim 9 wherein:

the tray-plate cradle has an inside periphery that is truncate conical;

the lid-plate cradle has an outside periphery that is truncate conical;

the outside periphery of the lid-plate cradle is sized and shaped to fit in the inside periphery of the tray-plate cradle;

the tray-bowl cradle has an inside periphery that is truncate conical;

the lid-bowl cradle has an outside periphery that is truncate conical;

the outside periphery of the lid-bowl cradle is sized and shaped to fit in the inside periphery of the tray-bowl cradle;

the tray-cup cradle has an inside periphery that is truncate conical;

the lid-cup cradle has an outside periphery that is truncate conical; and the outside periphery of the lid-cup cradle is sized and shaped to fit in the inside periphery of the tray-cup cradle.

11. The lap-tray and picnic-supply case of claim 10 wherein:

the at least one inside tray includes a plurality of inside trays which are duplicates of the inside tray.

12. The lap-tray and picnic-supply case of claim 11 wherein:

the inside tray and the duplicates of the inside tray have tray-plate cradles with outside peripheries that are truncate conical;

the outside peripheries of tray-plate cradles are sized and shaped to stack-fit in inside peripheries of other tray plate cradles successively;

the inside tray and the duplicates of the inside tray have tray-bowl cradles with outside peripheries that are truncate conical;

the outside peripheries of tray-bowl cradles are sized and shaped to stack-fit in inside peripheries of other tray-bowl cradles successively;

the inside tray and the duplicates of the inside tray have tray-cup cradles with outside peripheries that are truncate conical; and the outside peripheries of tray-cup cradles are sized and shaped to stack-fit in inside peripheries of other tray cup cradles successively.

13. The lap-tray and picnic-supply case of claim 12 wherein:

the tray-bowl cradles and the tray-cup cradles of the inside tray and the duplicates of the inside tray are extended downwardly predetermined distances proximate outsides of legs of users on whose laps the inside tray and the duplicates of the inside tray are positioned.

14. The lap-tray and picnic-supply case of claim 13 and further comprising:

a first tray-utensil cradle intermediate the tray-plate cradle and the tray-bowl cradle on the inside tray; and a second tray-utensil cradle intermediate the tray-plate cradle and the tray-cup cradle on the inside tray.

15. The lap-tray and picnic-supply case of claim 14 wherein:

the first tray-utensil cradle and the second tray-utensil cradle on the inside tray and the duplicates of the inside tray are extended downwardly predetermined distances to rest on legs of the users on whose laps the inside trays and the duplicates of the inside trays are positioned.

16. The lap-tray and picnic-supply case of claim 12 wherein:

the plate compartment, the bowl compartment and the napkin compartment have compartment walls with heights to accommodate a predetermined plurality of the inside trays stacked successively intermediate a bottom of the lap-tray lid positioned on the case receptacle and top edges of the compartment walls.

17. The lap-tray and picnic-supply case of claim 1 and further comprising:

a plurality of buffer feet on a case-rest side of the receptacle wall to position the attachment rim on the lap-tray lid vertically above a surface on which the case rest is positioned.

18. The lap-tray and picnic-supply case of claim 1 and further comprising:

at least one lid fastener with which the lap-tray lid is fastened to the case receptacle.

19. A lap-tray and picnic-supply case comprising:

a case receptacle having a lap-tray lid attached removably and stacking compartments for disposable plates, bowls, cups, utensils, napkins and other picnic supplies selectively;

the case receptacle having a receptacle floor with an outside periphery from which a receptacle wall is extended upwardly from a horizontal access orientation of the receptacle floor;

a lid-plate cradle intermediate a lid-bowl end with a lid-bowl cradle and a lid-cup end with a lid-cup cradle on a case lid;

a cup compartment proximate a case-bottom portion of the case receptacle with a horizontal wall for a case rest with the lap-tray and picnic-supply case in an upright position for being carried;

an attachment rim extended downwardly from an outside edge of the lap-tray lid to surround a top portion of the receptacle wall with the case receptacle and the lap-tray lid having shape-matching structure; and fastening means with which the lap-tray lid is fastened to the case receptacle.

20. A lap-tray and picnic-supply case comprising:

a case receptacle with a lap-tray lid attached removably;

the lap-tray lid having a lid-plate cradle intermediate a lid-bowl end with a lid-bowl cradle and a cup end with a lid-cup cradle;

a first utensil cradle intermediate the lid-plate cradle and the lid-bowl cradle;

a second utensil cradle intermediate the lid-plate cradle and the lid-cup cradle;

the lid-bowl cradle and the lid-cup cradle being extended downwardly outside of legs of a user on whose lap the lap-tray lid is positioned;

the case receptacle having a receptacle floor and a receptacle wall;

an attachment rim extended downwardly from an outside edge of the lap-tray lid to surround a top portion of the receptacle wall with the case receptacle and the lap-tray lid having shape-matching structure;

the first utensil cradle having a flat bottom surface and the second utensil cradle having a flat bottom surface to rest on the legs of the user proximate leg-rest positions internally from the attachment rim;

the case receptacle having a plate compartment vertically below the lid-plate cradle with the lap-tray lid positioned on the case receptacle, a bowl compartment vertically below the lid-bowl cradle with the lap-tray lid positioned on the case receptacle, a napkin compartment vertically below the lid-cup cradle with the lap-tray lid positioned on the case receptacle, and a utensil compartment vertically below the first utensil cradle with the lap-tray lid positioned on the case receptacle for vertical stacking in the case receptacle;

the case receptacle having a cup compartment proximate a case-bottom portion with a horizontal wall for a case rest with the lap-tray and picnic-supply case in an upright position for being carried;

a tray flat on the lap-tray lid intermediate the case-plate cradle and a case-rest portion of the lap-tray lid;

a retainer wall extended upwardly from the attachment rim to a predetermined height vertically above a lid-tray surface to deter falling of food items and food-container items off of the lap-tray lid when positioned for use on the user's lap or on other unstable, slanting or movable support bases;

the retainer wall having arcuate contact with the lid-tray surface and having an arcuate top edge; and the case receptacle and the lap-tray lid being made of a predeterminedly light, thin and rigid material.

21. The lap-tray and picnic-supply case of claim 20 wherein:

a predetermined portion of the lid-bowl end and a predetermined portion of the lid-cup end of the lap-tray lid and correspondingly shape-matching structure of the case receptacle are extended outwardly beyond ends of the case rest proximate the cup compartment of a shoulder embodiment.

22. The lap-tray and picnic-supply case of claim 20 wherein:

the case rest proximate the cup compartment has a length that is proximate a length of the lap-tray lid intermediate an outside edge of the lid-bowl end and an outside edge of the lid-cup end of the lap-tray lid of a rectangular embodiment.

23. The lap-tray and picnic-supply case of claim 20 and further comprising:

at least one inside tray having a tray-plate cradle intermediate a tray-bowl end with a tray-bowl cradle and a cup end with a tray-cup cradle;

the tray-plate cradle being axially concentric with the lid-plate cradle;

the tray-bowl cradle being axially concentric with the lid-bowl cradle;

the tray-cup cradle being axially concentric with the lid-cup cradle;

the inside tray having inside-tray ends sized and shaped to fit within ends an inside periphery of the case receptacle;

the tray-plate cradle has an inside periphery that is truncate conical;

the lid-plate cradle has an outside periphery that is truncate conical;

the outside periphery of the lid-plate cradle is sized and shaped to fit in the inside periphery of the tray-plate cradle;

the tray-bowl cradle has an inside periphery that is truncate conical;

the lid-bowl cradle has an outside periphery that is truncate conical;

the outside periphery of the lid-bowl cradle is sized and shaped to fit in the inside periphery of the tray-bowl cradle;

the tray-cup cradle has an inside periphery that is truncate conical;

the lid-cup cradle has an outside periphery that is truncate conical; and the outside periphery of the lid-cup cradle is sized and shaped to fit in the inside periphery of the tray cup cradle.

24. The lap-tray and picnic-supply case of claim 23 wherein:

the at least one inside tray includes a plurality of inside trays which are duplicates of the inside tray;

the inside tray and the duplicates of the inside tray have tray-plate cradles with outside peripheries that are truncate conical;

the outside peripheries of tray-plate cradles are sized and shaped to stack-fit in inside peripheries of other tray-plate cradles successively;

the inside tray and the duplicates of the inside tray have tray-bowl cradles with outside peripheries that are truncate conical;

the outside peripheries of tray-bowl cradles are sized and shaped to stack-fit in inside peripheries of other tray-bowl cradles successively;

the inside tray and the duplicates of the inside tray have tray-cup cradles with outside peripheries that are truncate conical;

the outside peripheries of tray-cup cradles are sized and shaped to stack-fit in inside peripheries of other tray cup cradles successively; and the tray-bowl cradles and the tray-cup cradles of the inside tray and the duplicates of the inside tray are extended downwardly predetermined distances proximate outsides of legs of users on whose laps the inside tray and the duplicates of the inside tray are positioned.

* * * * *